US006302310B1

(12) United States Patent
Lamb

(10) Patent No.: US 6,302,310 B1
(45) Date of Patent: Oct. 16, 2001

(54) STAPLE OR NAIL GUN ASSEMBLY, CAP FEEDING DEVICE FOR STAPLE OR NAIL GUN, AND CAP ASSEMBLY

(76) Inventor: Frederick W. Lamb, 2101 King Charles Cir., Alabaster, AL (US) 35007

( * ) Notice: Subject to any disclaimer, the term of this patent is extended or adjusted under 35 U.S.C. 154(b) by 0 days.

(21) Appl. No.: 09/438,983

(22) Filed: Nov. 12, 1999

Related U.S. Application Data

(60) Provisional application No. 60/108,174, filed on Nov. 13, 1998.

(51) Int. Cl.[7] ..... B25C 7/00

(52) U.S. Cl. ..... 227/119; 227/120; 227/136; 221/232

(58) Field of Search ..... 227/107, 120, 227/119, 18, 135, 136, 128, 139; 221/232, 238; 81/57.37

(56) References Cited

U.S. PATENT DOCUMENTS

| | | | | |
|---|---|---|---|---|
| 2,385,521 | * | 9/1945 | Mead | 221/232 |
| 2,886,815 | * | 5/1959 | Young | 227/120 |
| 3,261,526 | * | 7/1966 | Novak | 227/136 |
| 3,595,460 | * | 7/1971 | Pitkin | 227/120 |
| 3,604,608 | * | 9/1971 | Mullaney | 227/120 |
| 3,633,810 | * | 1/1972 | Krakauer | 227/120 |
| 3,734,377 | * | 5/1973 | Munn | 227/120 |
| 4,033,499 | * | 7/1977 | Butler | 227/120 |
| 4,251,017 | * | 2/1981 | Doyle et al. | 227/136 |
| 4,339,065 | * | 7/1982 | Haytayan | 227/120 |
| 4,424,929 | * | 1/1984 | Weis | 227/120 |
| 5,042,142 | | 8/1991 | Beach et al. | 29/787 |
| 5,184,752 | | 2/1993 | Zylka et al. | 221/1 |
| 5,347,707 | | 9/1994 | Beach | 29/809 |
| 5,445,297 | | 8/1995 | Beach et al. | 221/257 |
| 5,634,583 | * | 6/1997 | McGuinness et al. | 227/120 |
| 5,791,546 | | 8/1998 | McGuinness et al. | 227/120 |
| 5,921,454 | * | 7/1999 | Larson et al. | 227/18 |
| 5,934,504 | * | 8/1999 | Elliott | 221/232 |
| 5,947,362 | * | 9/1999 | Omli | 227/120 |

* cited by examiner

*Primary Examiner*—Scott A. Smith
(74) *Attorney, Agent, or Firm*—Garvey, Smith, Nehrbass & Doody, L.L.C.

(57) ABSTRACT

A staple or nail gun assembly includes a staple or nail gun and a cap feeding device. The staple or nail gun and the cap feeding device are generally disposed at opposite ends of the handle of the staple or nail gun. The cap feeding device includes a base, a cap container and a shuttle. The base has a cap feeding chamber and a cap holding chamber and a channel connecting the two chambers. The container is used to store staple or nail caps and to feed the caps to the cap feeding chamber of the base, one cap at a time. The shuttle is operatively associated with the channel of the base to move a cap at the cap feeding chamber towards the cap holding chamber through the channel by a distance equal to the diameter of the cap.

20 Claims, 9 Drawing Sheets

STAPLE OR NAIL GUN ASSEMBLY, CAP FEEDING DEVICE FOR STAPLE OR NAIL GUN, AND CAP ASSEMBLY

This application claims the priority of U.S. provisional patent application Ser. No. 60/108,174, filed Nov. 13, 1998, which is incorporated by reference in its entirety.

FIELD OF THE INVENTION

This invention relates to a cap feeding device for a staple or nail gun, as well as a staple or nail gun assembly and a cap assembly for use with a cap feeding device.

BACKGROUND OF THE INVENTION

Automatic nail guns, powered by compressed air or electricity, are used, for example, to attach roofing material, such as tarpaper, to the roof of a house. A generally flat cap is often used with each nail. A nail penetrates the cap and the tarpaper and protrudes into the underlying roof structure, attaching the roofing material to the roof surface.

Typically, an operator must manually place and hold a cap under the nose of a nail gun and then trigger the gun to drive a nail though the cap into the roof structure. The manual placement of caps presents a serious safety hazard to the operator because the operator's hand is close to the nose of the gun when a nail is driven through the nose of the gun. In addition, manual placement of caps is time-consuming and inefficient.

A cap feeding device may be employed to reduce the risk associated with manual placement of caps and to improve the efficiency of roofing operation. The cap feeding device automatically places a cap under the nose of a nail gun, and then the nail gun drives a nail through the cap and into the underlying roof structure.

A conventional cap feeding device generally includes a cap container and a base having a channel. The base extends between the cap container and a position under the nose of the nail gun. Caps are fed into the channel of the base from the cap container and pushed to the position under the nose of the nail gun. When the gun is triggered, a nail penetrates and dislodges the cap under the nose of the nail gun and protrudes into the underlying roof structure. The feeding of the caps under the nose of the nail gun is coordinated with the ejection of the nails through the nose of the nail gun, so that a cap is placed under the nose of the gun before the gun is triggered to expel a nail.

Conventional cap feeding devices have a number of drawbacks. For example, conventional cap feeding devices are generally heavy, putting additional stress on the operator's hand holding the nail gun. Also, many conventional cap feeding devices can only be installed close to the front end of a nail gun, making the nail gun not only heavy but also unbalanced with most of the weight placed at the front end of the gun. This makes the nail gun difficult to handle and may put stress on the operator's hand and wrist. In addition, with so many components placed near the nose of the gun, it is difficult to see the position of the nose of the gun, making a precise placement of a nail difficult.

The conventional cap feeding devices are installed close to the front end of the gun because designers need to place a conventional cap container close to the nose of the gun to reduce the weight of the cap feeding device. The reason is that in many devices a cap is pushed directly from the cap container to a position under the nose of the nail gun. Thus, if the cap container is far from the nose of the gun, a long shuttle is needed to push a cap from the container to the position under the nose of the nail gun through the channel of the base. In addition, an actuator, such as an air cylinder, with a long displacement is also needed to drive the shuttle. The displacement of the actuator should be about the same as the distance between the cap container and the nose of the nail gun. A long shuttle and actuator increase the weight and size of the cap feeding device. With the cap feeding device placed near the nose of the gun, the shuttle and actuator, thus the cap feeding device, can be made lighter, smaller and less expensive.

SUMMARY OF THE INVENTION

This invention provides a compact, light-weight cap feeding device that overcomes the problems associated with conventional nail guns and cap feeding devices.

In accordance with one aspect of the invention, a device, which is used to feed staple or nail caps having a diameter, includes a base, a container and a shuttle. The base includes cap feeding and cap holding chambers, and a channel connecting the two chambers. The distance between the cap feeding and cap holding chambers is at least twice the diameter of the caps. The container has a generally cylindrical configuration and is substantially perpendicular to the base. The container is operatively associated with the cap feeding chamber and is adapted to feed caps stored in the container into the cap feeding chamber one cap at a time. The shuttle is adapted to slide within the channel of the base and is adapted to move a cap at the cap feeding chamber through the channel towards the cap holding chamber by a distance equal to a diameter of the cap.

In accordance with another aspect of the invention, a staple or nail gun assembly includes a staple or nail gun and a cap feeding device. The staple or nail gun has a head portion and a handle portion. The head portion has an opening through which a staple or nail is expelled. The handle portion has first and second ends, the first end being attached to the head portion. The cap feeding device includes a base, a container and a shuttle. The base includes cap feeding and cap holding chambers, and a channel connecting the two chambers. The distance between the cap feeding and cap holding chambers is at least twice the diameter of the caps. The container has a generally cylindrical configuration and is substantially perpendicular to the base, facilitating the transfer of caps from the container to the cap feeding chamber. The container is operatively associated with the cap feeding chamber and is adapted to feed caps stored in the container into the cap feeding chamber one cap at a time. The shuttle is adapted to slide within the channel of the base and is adapted to move a cap at the cap feeding chamber through the channel towards the cap holding chamber by a distance equal to a diameter of the cap.

In accordance with a further aspect of the invention, a cap assembly for use with a cap feeding device includes a plurality of concentrically stacked staple or nail caps. Each cap has two opposite surfaces, and at least one of the surfaces of each cap is attached to one of the surfaces of another cap.

The cap feeding device and the staple or nail gun assembly of the present invention are compact and light-weight and thus have a number of advantages over the prior art. The weight of a staple or nail gun assembly in accordance to the present invention is substantially balanced. The weight of the staple or nail gun is mostly located at the front end of the gun handle, while the weight of the cap feeding device, especially the weight of the cap container, is mostly located at the rear end of the gun handle. Further, although the cap container is not placed near the nose of the gun, an actuator with a long displacement is not needed because a cap is not pushed directly from the cap feeding chamber to the cap holding chamber. The cap in the cap feeding chamber is pushed by the shuttle towards the cap holding chamber by a distance equal to the diameter of the cap (if the cap is circular). This cap pushes the cap in front of it in the channel towards the cap holding chamber by the same distance. The last cap is pushed into the cap holding chamber, where a staple or nail penetrates the cap in the cap holding chamber when the gun is triggered. In other words, there are at least three caps in the channel of the base, one at the cap feeding chamber, one at the middle position and one at the cap holding chamber. Each time after the gun is triggered, the caps are moved towards the cap holding chamber by a distance equal to the diameter of the caps. In addition, because most of the components of the cap feeding device are not located near the nose of the gun, an operator is able to see the nose of the gun better, allowing him to more precisely aim the nose of the gun.

DETAILED DESCRIPTION OF THE PREFERRED EMBODIMENTS

Figure 1:
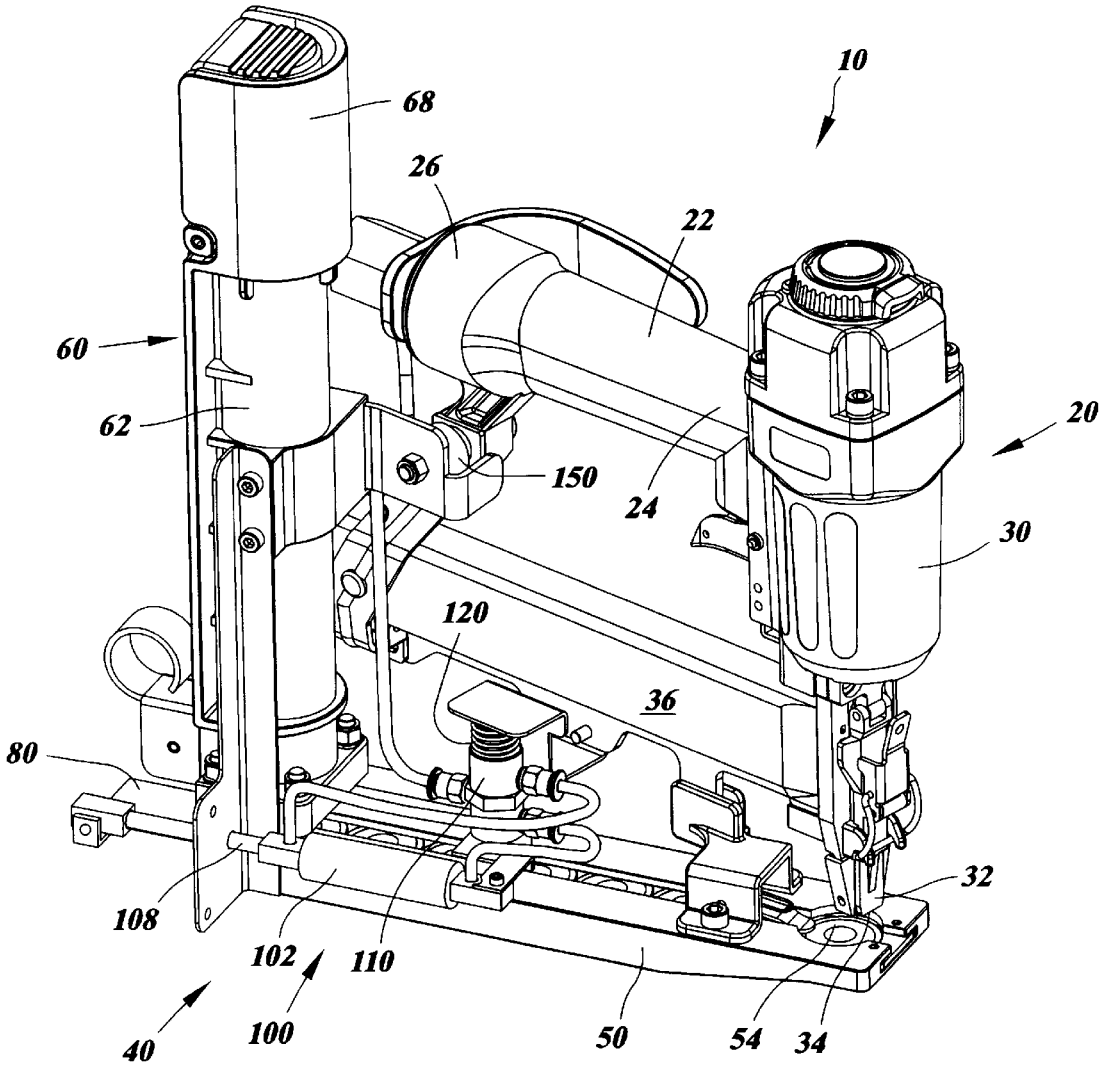
FIG. 1 is a perspective view of a staple or nail gun assembly according to the present invention.

FIGS. 1–8 illustrates one example of the staple or nail gun assembly 10 of the present invention. The staple or nail gun assembly 10 includes a staple or nail gun 20 and a cap feeding device 40. The staple or nail gun 20 has a handle portion 22 and a head portion 30. The handle portion 22 has front and rear ends 24, 26, the front end 24 being attached to the head portion 30. The cap feeding device 40 includes a base 50, a cap container 60 and a shuttle 80. The base 50 includes a cap feeding chamber 52 and a cap holding chamber 54, and a channel 56 connecting the two chambers 52, 54. The container 60 is used to store staple or nail caps 140 and to feed the caps 140 to the cap feeding chamber 52 of the base 50 one cap at a time. The shuttle 80 is movably disposed in the channel 56 of the base 50 and is adapted to move a cap at the cap feeding chamber 52 towards the cap holding chamber 54 through the channel 56.

In the preferred embodiment shown in FIG. 1, the staple or nail gun 20 is an automatic nail gun powered by compressed air, although any staple or nail gun can be used with an embodiment of present invention, including a staple or nail gun powered, for example, by electricity. The head portion 30 of the nail gun 20 includes a nose portion 32 and a barrel having an opening 34 at the nose portion 32. The nail gun 20 may also include a nail container 36 connected to the head portion 30. The nail container 36 holds a plurality of nails and feeds the nails into the barrel one nail at a time. The head portion 30 may also include a piston-cylinder arrangement, in which a piston is movably disposed in a cylinder and divides the cylinder into first and second chambers. When the nail gun 20 is triggered, compressed air is supplied to the first chamber of the cylinder to push the piston towards the nail in the barrel. The piston strikes the nail in the barrel to eject the nail through the opening 34 at the nose portion 32. Then compressed air can be supplied to the second chamber to return the piston to the retracted position. Alternatively, the piston may be returned to the retracted position with any alternative device such as a spring. Because the head portion 30, which contains most of the nail gun components, is disposed at the front end 24 of the handle portion 22, the weight of the staple or nail gun 20 is mostly placed at the front end 24 of the handle 22.

As stated above, the cap feeding device 40 includes a base 50, a cap container 60 and a shuttle 80. The base 50 has a cap feeding chamber 52 and a cap holding chamber 54, and a channel 56 connecting the two chambers 52, 54. The container 60 is used to store nail caps 140 and to feed the caps 140 to the cap feeding chamber 52 of the base 50 one cap at a time. The shuttle 80 is operatively associated with the channel 56 of the base 50 and pushes a cap at the cap feeding chamber 52 towards the cap holding chamber 54 through the channel 56.

Figure 2:
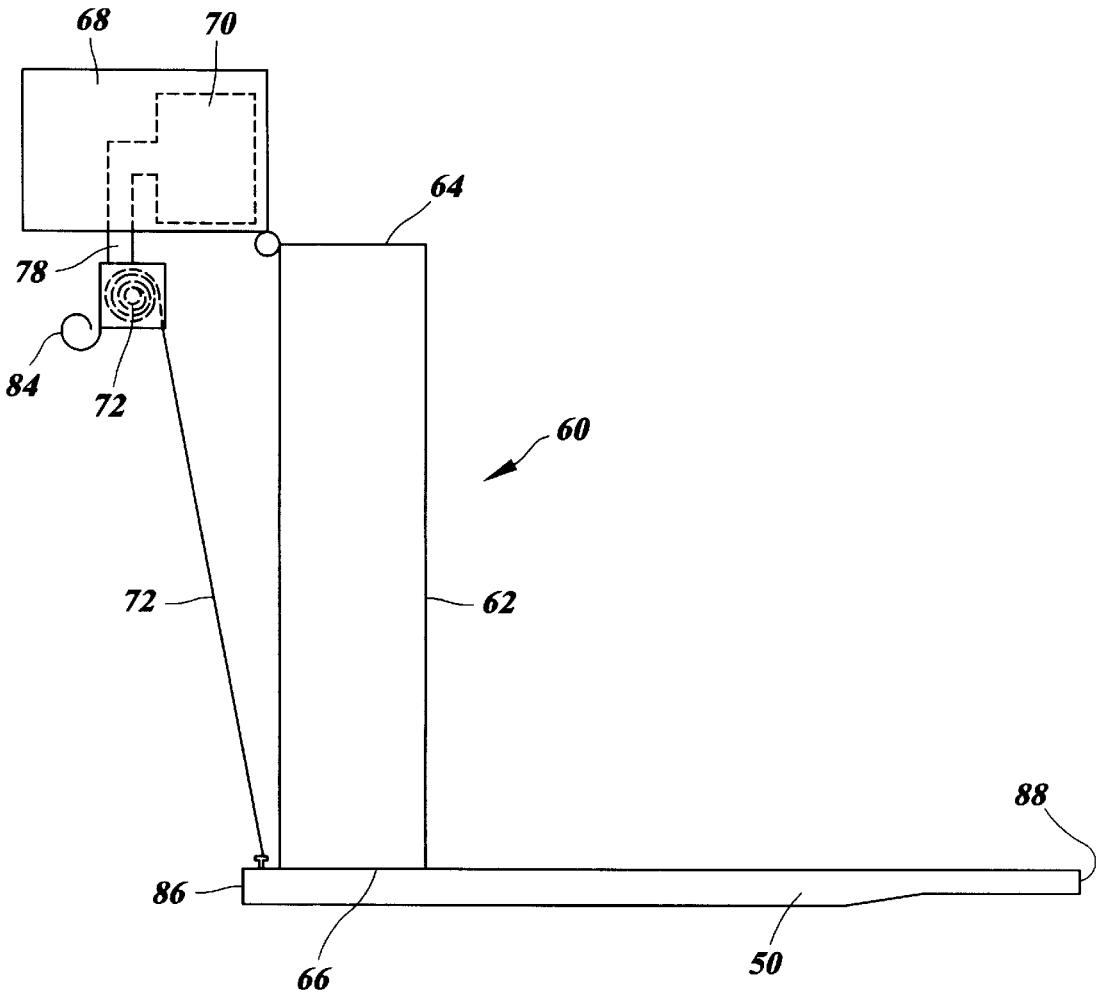
FIG. 2 is a side view of a cap container of the embodiment shown in FIG. 1, where the cover is in the open position.
Figure 3:
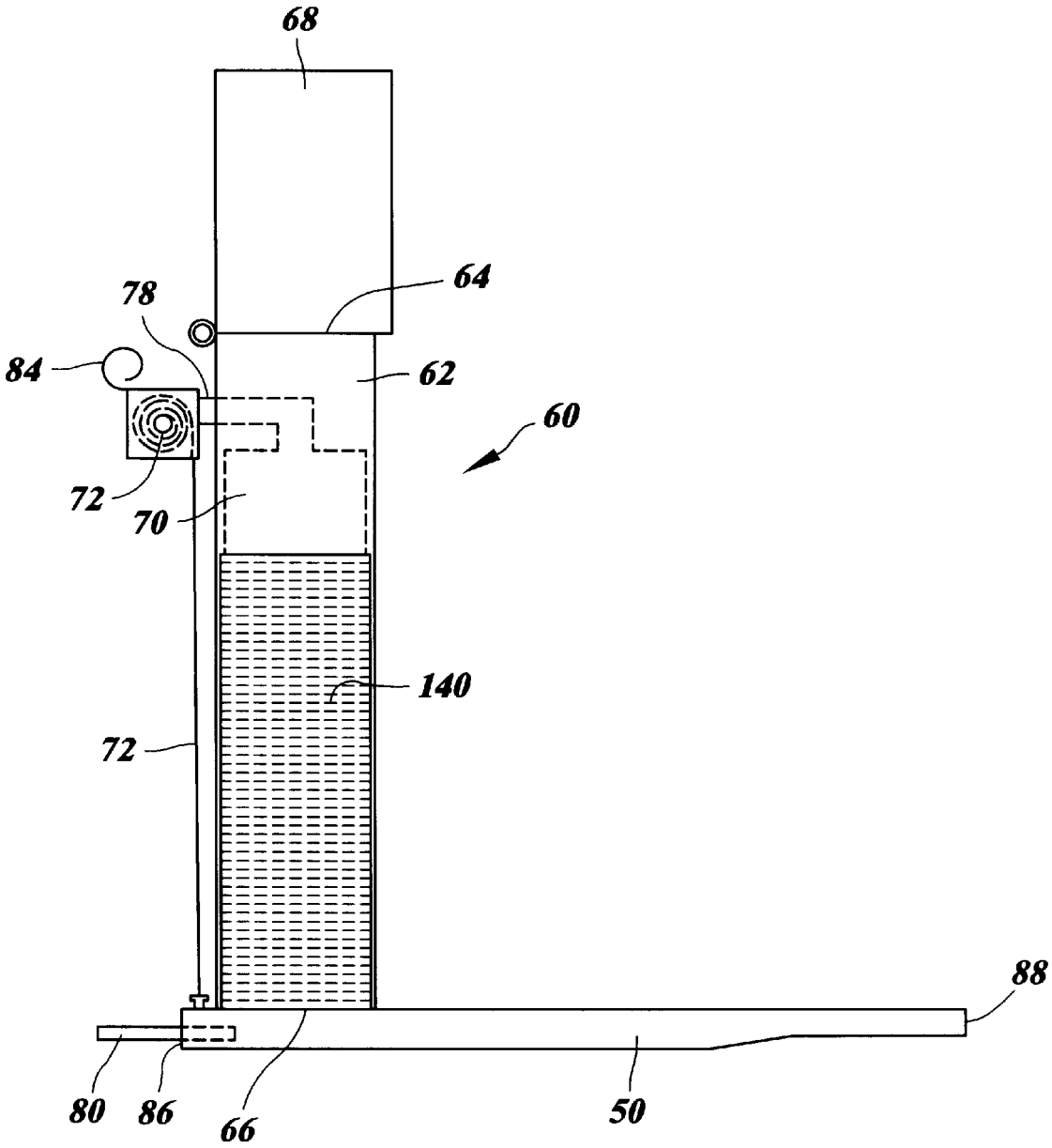
FIG. 3 is the side view of the cap container shown in FIG. 2, where the cover is in the closed position.
Figure 4:
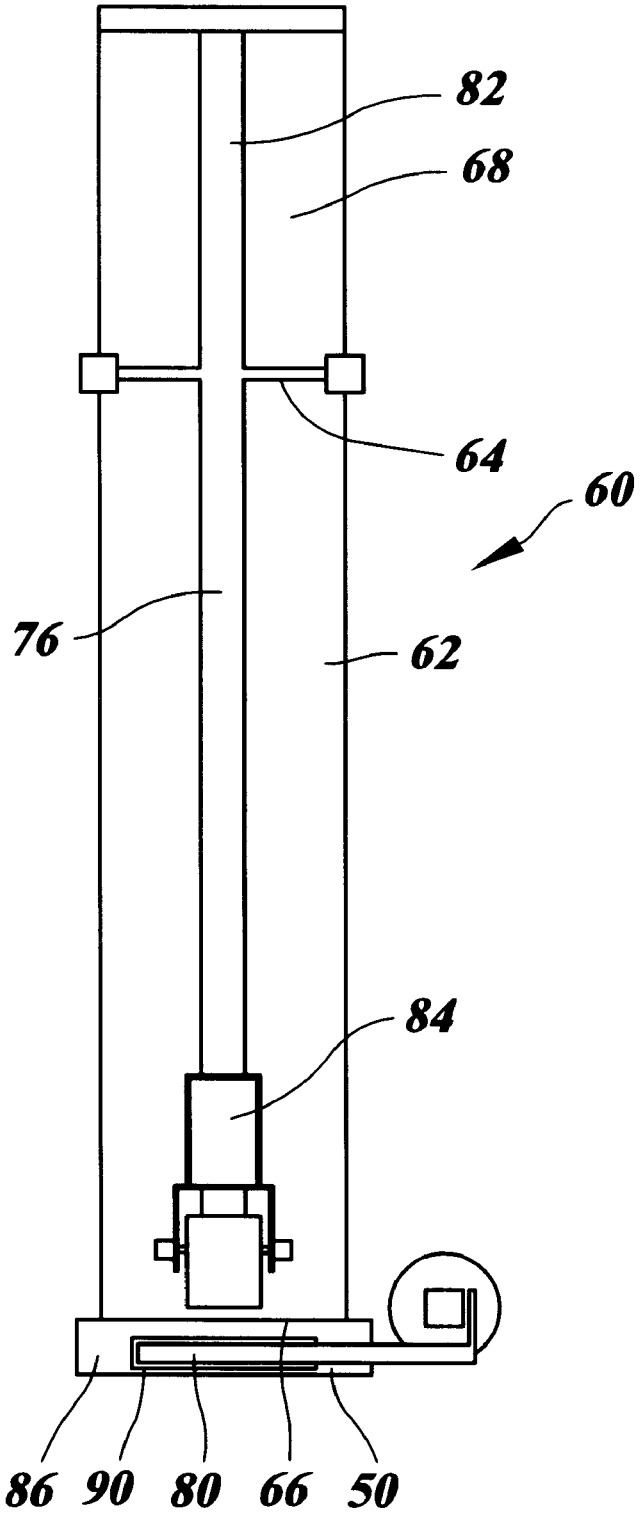
FIG. 4 is a rear view of the cap container shown in FIGS. 2 and 3.

As illustrated in FIGS. 2–4, the cap container 60 includes a hollow tubular portion 62 having first and second open ends 64, 66, and a cover 68 pivotably connected to the tubular portion 62 at the first open end 64. The second open end 66 of the tubular portion 62 is aligned with the cap feeding chamber 52 of the base 50, and the caps 140 in the container 62 are fed to the cap feeding chamber 52 through the second open end 66. In this embodiment, the tubular portion 62 is attached to the base 50 with a plurality of bolts and nuts. In the illustrated preferred embodiment, the tubular portion 62 is perpendicular to the base 50. The container 60 also includes a plunger 70, which may be disposed in the tubular portion 62 or disposed in the cover 68, and a spring 72, such as a ribbon spring 72 shown in FIGS. 2–4, pulling the plunger 70 towards the second end 66 of the tubular portion 62. The spring force biases the plunger 70 against the stack of caps 140 in the direction of the second end 66 to ensure that the outermost cap at the second end 66 is disposed in the cap feeding chamber 52 of the base 50. In the embodiment shown in FIGS. 2–4, the tubular portion 62 includes a longitudinal slot 76 in its wall, and the plunger 70 disposed in the tubular portion 62 includes a knob 78 extending to the exterior of the tubular portion 62 through the longitudinal slot 76. The cover 68 may also include a slot 82 aligned with the slot 76 of the tubular portion 62 so that the plunger 70 can be lifted into the cover 68 from the tubular portion 62 by pulling the knob 78 or a handle 84 attached to the knob 78. When the plunger 70 is in the cover 68, the cover 68 can be placed in the open position, as shown in FIG. 2, and the spring force keeps the cover 68 in the open position. After the cover 68 is placed in the open position, a coaxial stack of caps 140 can be disposed in the tubular portion 62. Then the plunger 70 is put back in the tubular portion 62 and the cover 68 is placed in the closed position, as shown FIG. 3.

Figure 9A:
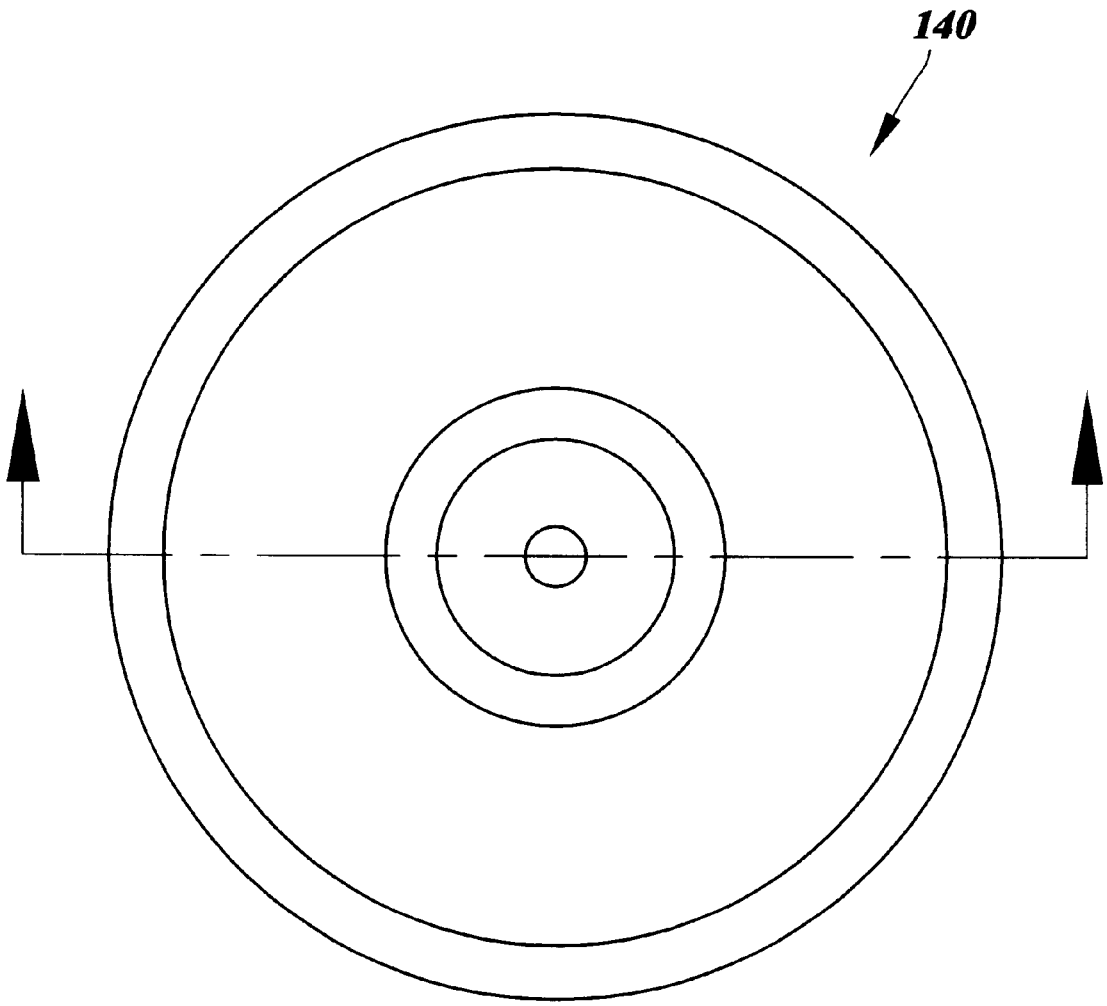
FIG. 9*a* is a top view of a cap used in the present invention.
Figure 9B:
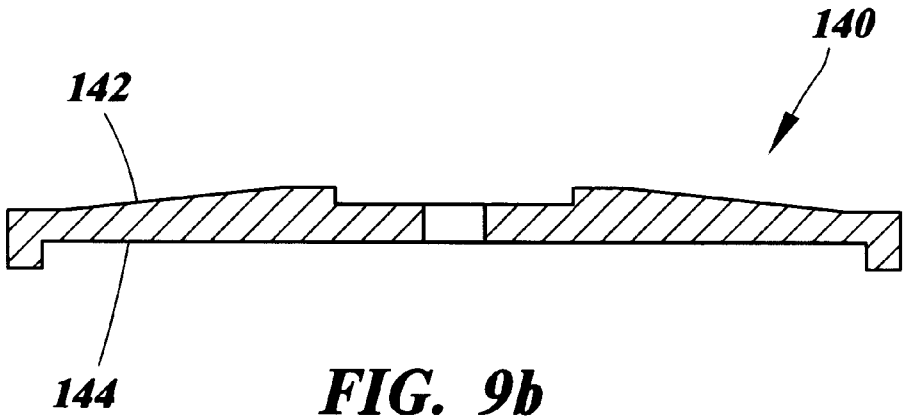
FIG. 9*b* is a cross sectional drawing of the cap shown in FIG. 9*a*.

In a preferred embodiment shown in FIGS. 9*a* and 9*b*, the caps 140 each have two opposite surfaces 142, 144 with at least one surface 142, 144 of each cap attached to a surface 142, 144 of another cap. In a preferred embodiment, the cap is circular, with a diameter of about 1 inch and a thickness of about 1/16 inch. The caps 140 can be attached to one another in several ways. For example, the caps 140 may be glued to each other, or they may be attached by friction fit. Alternatively, the stack of caps may include grooves on the opposite sides of the stack, and the caps may be held together with a string, such as a wax or plastic string, disposed on the grooves. A stack of caps 140 may include any number of caps, for example, 100 caps. A stack of caps 140 attached to each other is easier to handle and to load into the cap container 60.

The base 50 has a generally flat, elongated rectangular configuration and is used to transport caps 140 from the cap feeding chamber 52 to the cap holding chamber 54 under the nose 32 of the nail gun 20. The cap feeding and cap holding chambers 52, 54 are disposed respectively near the first and second ends 86, 88 of the base 50. The distance between the cap feeding and cap holding chambers 52, 54 is such that the cap feeding chamber 52 (and thus the cap container 60) is near the rear end 26 of the handle portion 22, and the cap holding chamber 54 is under the nose 32 of the nail gun 20. The cap feeding chamber 52 includes an indentation having a configuration similar to that of the caps 140 for accommodating a cap. In the illustrated embodiment, for example, the cap feeding chamber 52 includes an indentation 90 having a circular configuration which is similar to the flat circular configuration of the caps 140. The cap holding chamber 54 has a generally circular through hole having a configuration similar to that of caps 140.

Figure 6:
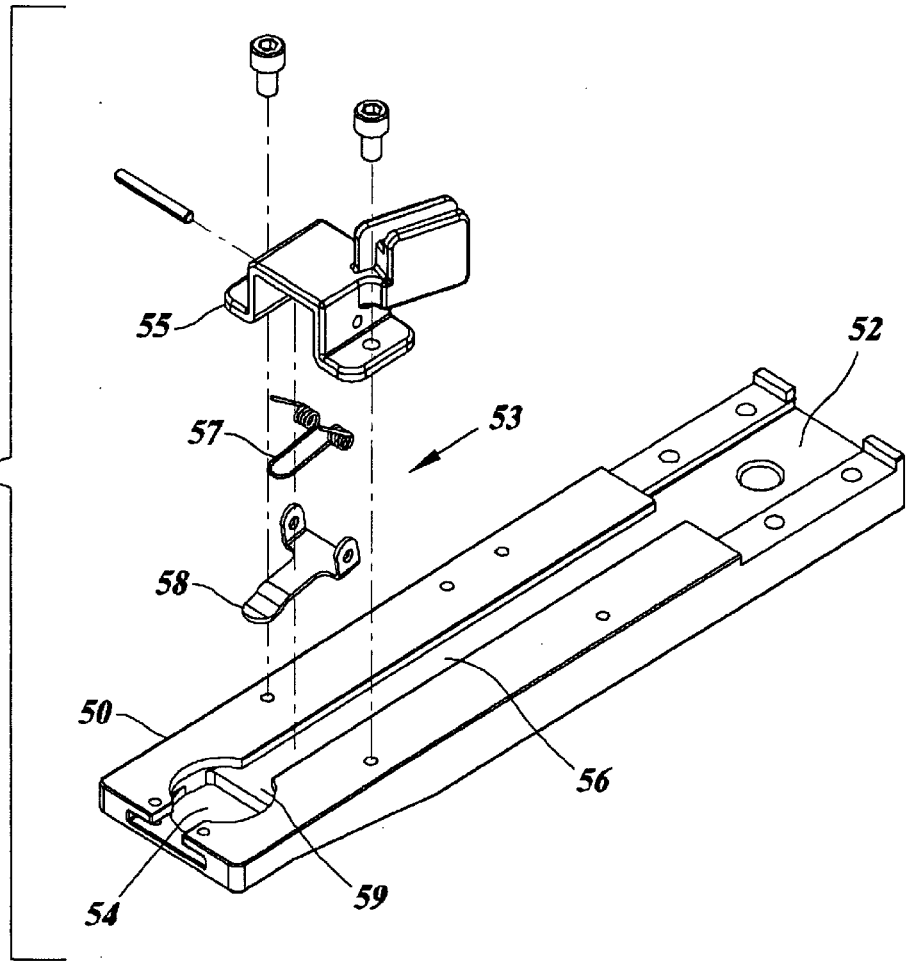
FIG. 6 is an exploded view of a mechanism for holding a cap in the cap holding chamber of the base.
Figure 7:
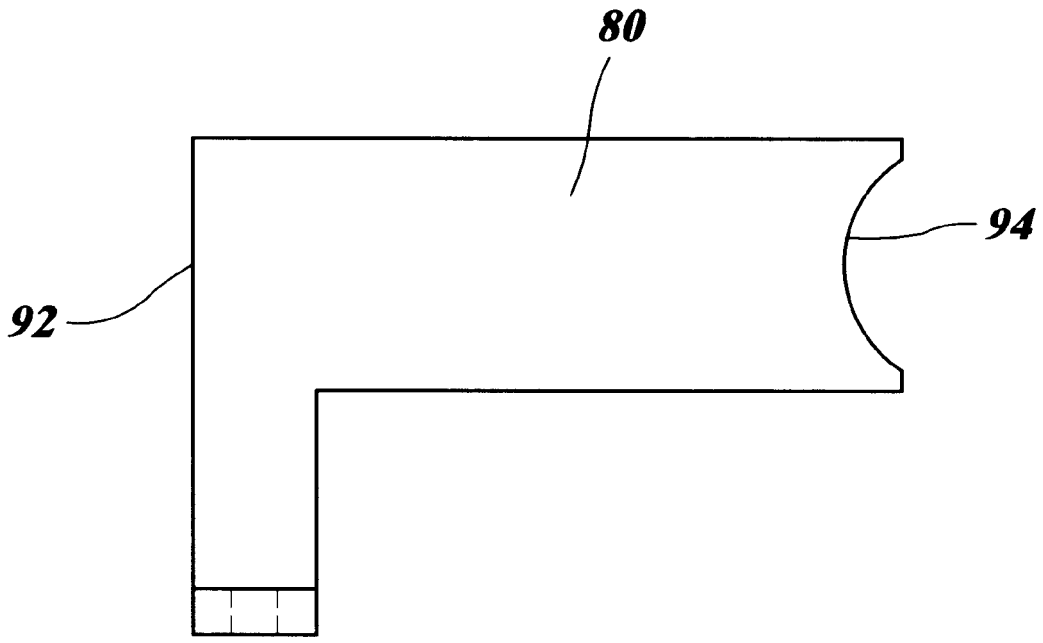
FIG. 7 is a top view of the shuttle shown in FIG. 5.

A cap holding mechanism may be provided to hold a cap in the cap holding chamber 54 and to allow a cap to go through the cap holding chamber 54 when a nail is ejected through the nose 32 of the nail gun 20 and strikes the cap. The cap holding mechanism 53 used in the illustrated embodiment is shown in FIG. 6. The cap holding mechanism 53 includes a feeding pawl 58 and a spring 57. The feeding pawl 58 and spring 57 are attached to the base 50 by a bracket 55. The spring 57 presses the feeding pawl 58 against a ledge 59 which extends from the bottom of the channel 56 into the circular cap holding chamber 54. As a cap is pushed into the cap holding chamber 54, the cap passes between the ledge 59 and the feeding pawl 58. When the cap is placed in the cap holding chamber 54, the feeding pawl 58 presses the cap against the ledge 59 and holds the cap in the cap holding chamber 54. When a nail is ejected through the nose 32 of the nail gun 20 and strikes the cap, the feeding pawl 58 releases the cap and allows the cap to go through the cap holding chamber 54.

The channel 56 extends between the cap feeding chamber 52 and the cap holding chamber 54. At the cap feeding chamber 52, the channel 56 extends beyond the cap feeding chamber 52 and intersects the first end surface 86 of the base 50 to form an opening 90. Preferably, the bottom surface of the cap feeding chamber 52 is flush with the bottom surface of the channel 56 so that a cap disposed in the cap feeding chamber 52 can be pushed into the channel 56 towards the cap holding chamber 54. At the cap holding chamber 54, the channel 56 does not extend beyond the cap holding chamber 54 so that a cap can only be fed to the cap holding chamber 54 from the channel 56 but not beyond cap holding chamber 54. The channel 56 has a cross section similar to the cross section of the caps 140. For example, the channel 56 in the illustrated embodiment has a rectangular cross section with its width similar to the diameter of the caps 140 and with its height similar to the height of the caps 140. In this way, only one cap can be pushed into the channel 56 from the cap feeding chamber 52, and the channel 56 can accommodate only one cap at any particular position.

As illustrated in FIGS. 4, 5, 7 and 8, the shuttle 80 has a generally flat rectangular configuration. At least a portion of the shuttle 80 is movably disposed in the channel 56 of the base 50 through the opening 90 of the channel 56. The rest of the shuttle 80 may be outside of the channel 56 or may also be disposed in the channel 56. Preferably, the cross section of the shuttle 80 is similar to or slightly smaller than that of the caps 140 and that of the channel 56. In the illustrated embodiment, the first end 92 of the shuttle 80 is outside of the channel 56 while the second end of the shuttle 80 is disposed in the channel 56. The shuttle 80 is movable within the channel 56 between a forward position and a back position. At the forward position, the second end 94 of the shuttle 80 is between the cap feeding chamber 52 and the cap holding chamber 54. At the back position, the second end 94 is between the cap feeding chamber 52 and the opening 90 of the channel 56. When the shuttle 80 moves from the back position to the forward position, the second end 94 of the shuttle 80 pushes a cap in the cap feeding chamber 52 towards the cap holding chamber 54 by a distance substantially equal to the diameter of each of the caps 140. Preferably, the second end 94 of the shuttle 80 has a semicircular configuration that conforms to the side surface of each of the caps 140.

Figure 5:
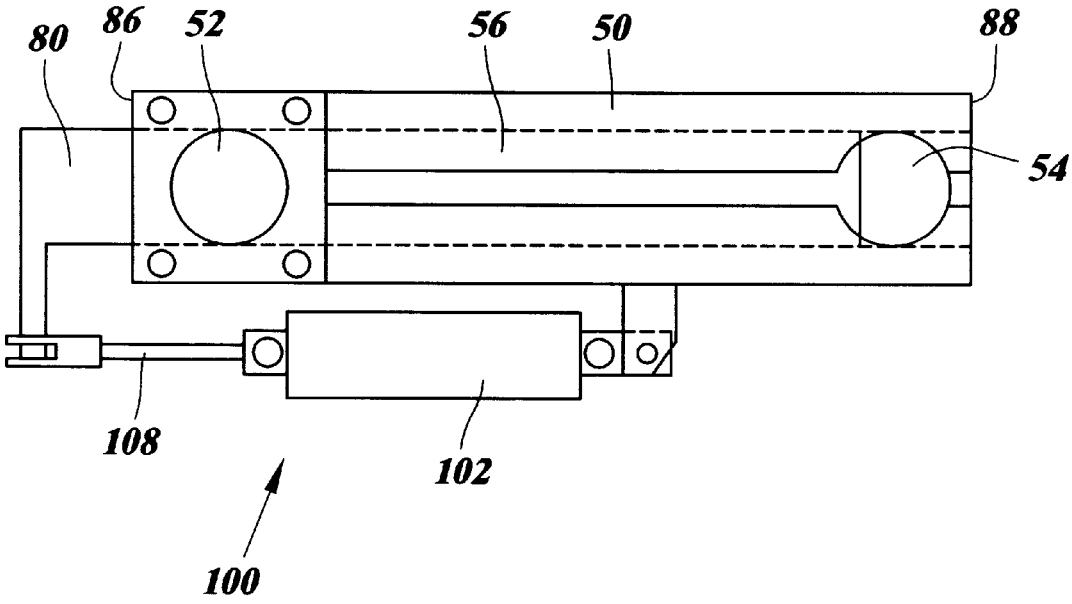
FIG. 5 is a top view of a base, a shuttle and a piston-cylinder arrangement of the embodiment shown in FIG. 1.
Figure 8:
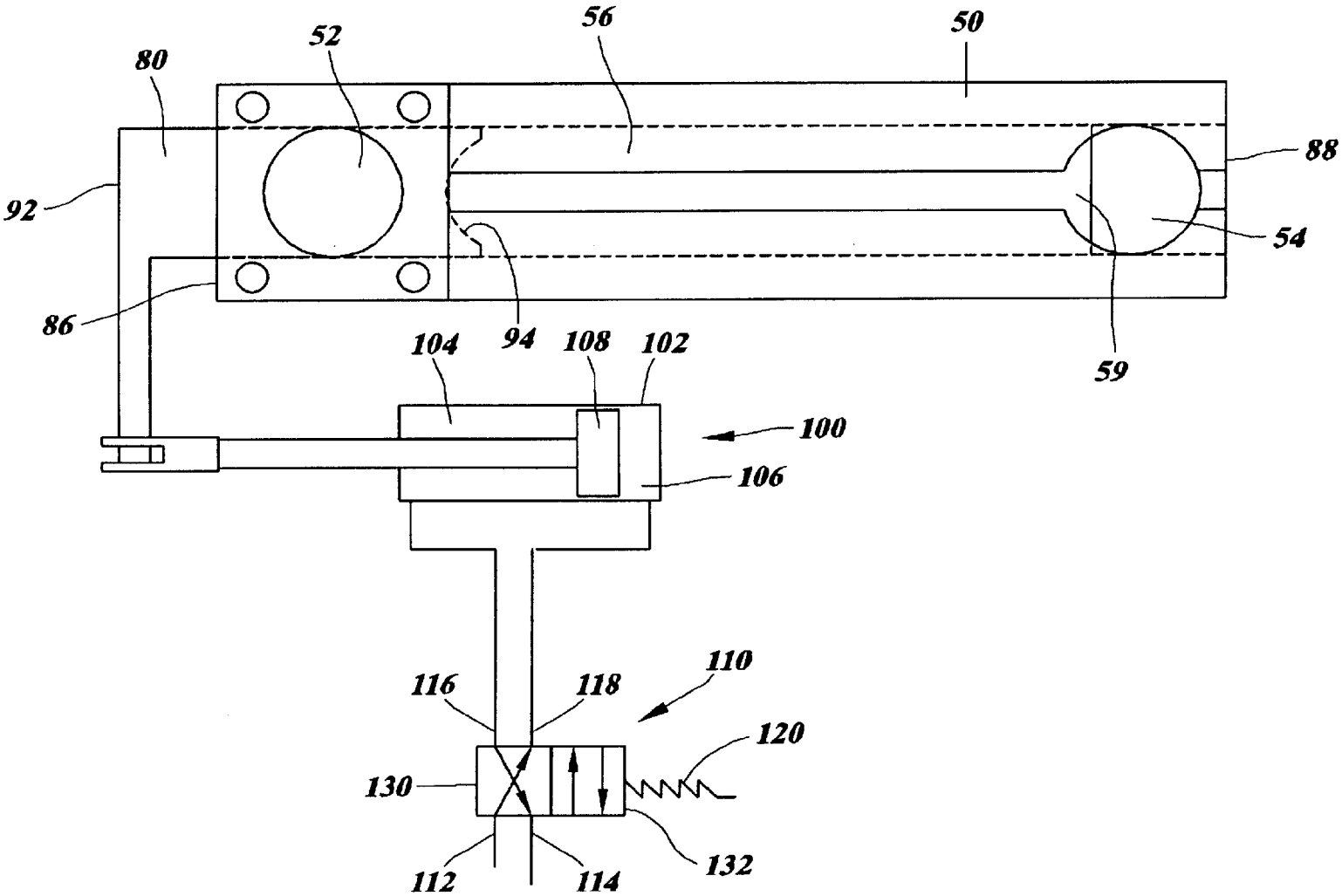
FIG. 8 is a schematic drawing of the system controlling the movement of the shuttle.

As shown in FIGS. 1, 5 and 8, a piston-cylinder arrangement 100, powered by compressed air, is connected to the portion of the shuttle 80 outside of the channel 56 (or any portion of the shuttle 80) to move the shuttle 80 in the channel 56. Alternatively, any linear or rotational actuator, such as an electric or hydraulic motor, may be used to move the shuttle 80 in a desired manner. Although not shown in the Figures, a shield or guard may be provided to cover the moving piston and/or the second end 92 of the shuttle 80 to protect the operator from injury. The cylinder 102 includes a forward chamber 104 and a back chamber 106, which are separated by the piston 108. Compressed air can be supplied either to the forward chamber 104 or to the back chamber 106 to move the piston 108 within the cylinder 102. The supply of compressed air to the chambers 104, 106 of the cylinder 102 is controlled by a four-way, two-position valve 110, as shown in FIG. 8. Compressed air can be supplied to the cylinder 102 from the nail gun 20 or from another source.

The positioning of the valve 110, thus the movement of the piston 108 and shuttle 80, is coordinated with the relative movement of the nail gun 20 and the cap feeding device 40. The nail gun 20 and the cap feeding device 40 are pivotably attached to each other at a joint 150. A spring 120 disposed between and connected to the nail gun 20 and the cap feeding device 40 normally biases the cap feeding device 40 and the nail gun 20 against each other and keeps the nose portion 32 of the nail gun 20 apart from the cap holding chamber 54 of the base 50. When the base 50 is placed on a roof surface and the nail gun 20 is pressed towards the base 50, the spring 120 is compressed, allowing the nose portion 32 to be positioned just above the cap holding chamber 54. In this position, the nail gun 20 can be triggered to expel a nail through the opening 34 of the nose 32.

The coordination between the movement of the shuttle 80 and the relative movement between the nail gun 20 and the cap feeding device 40 can be explained while referring to the schematic drawing in FIG. 8. The four-way, two-position valve 110 includes an air pressure port 112, an exhaust port 114, and forward and back ports 116, 118 connected respectively to the forward and back chambers 104, 106 of the cylinder 102. At the first valve position 130, the pressure port 112 is connected to the back port 118, and the exhaust port 114 is connected to the forward port 116. Compressed air is supplied to the back chamber 106 of the cylinder 102, and the forward chamber 104 is connected the exhaust port 114. At the second valve position 132, compressed air is supplied to the forward chamber 104, and the back chamber 106 is connected to the exhaust port 114. Normally, the nail gun 20 and the cap feeding device 40 are kept apart by the spring 120, and the valve 110 is in the first position. At this position, compressed air is supplied to the back chamber 106, and the shuttle 80 is in the back position. When the nail gun 20 is pressed towards the base 50 of the cap feeding device 40, the spring 120 is compressed, and the spring 120 pushes the valve 110 into the second position 132. At this position, compressed air is supplied to the forward chamber 104 and the shuttle 80 is moved to the forward position.

The operation of the nail gun assembly 10, which includes the cap feeding device 40, can be described while referring to FIGS. 1–8. If the cap container 60 is empty at the beginning of the operation, the plunger 70 can be lifted into the cover 68, and the cover 68 can be placed in the open position. A stack of caps 140 attached to one another is disposed in the cap container 60. The plunger 70 then is put back into the container 60, and the cover 68 is placed in the closed position. If there are no caps in the channel 56 of the base 50 at this time, caps 140 can be fed into the channel 56. To do so, the nail gun assembly 10 is placed on a surface such as a roof surface, and the nail gun 20 is pressed towards the base 50 to compress the spring 120. The spring 120 then presses the valve 110 to put the valve 110 in the second valve position, and compressed air is supplied to the forward chamber 104 of the cylinder 102 and pushes the piston 108 to the forward position. The shuttle 80 is pushed to the forward position by the piston 108, and the shuttle 80 pushes the cap in the cap feeding chamber 52 towards the cap holding chamber 54 by a distance equal to the diameter of one of the caps 140. When the nail gun assembly 10 is lifted off the roof surface, the spring 120 pushes the nail gun 20 and the cap feeding device 40 apart, and the valve 110 returns to the first valve position. The shuttle 80 is moved to the back position and a cap is fed into the cap feeding chamber 52. This is repeated until the channel 56 is full of caps but a cap is not yet fed into the cap holding chamber 54. While doing this, the nail gun 20 need not be triggered to discharge a nail each time a cap is advanced in the channel 56. After a cap is loaded into the cap holding chamber 54, the nail gun assembly 10 is ready for use. The nail gun assembly 10 can then be placed on a piece of roof material, such as a piece of tarpaper, placed over a roof surface. The nail gun 20 is pressed towards the base 50. The shuttle 80 moves to the forward position and pushes the cap in the cap feeding chamber 52 towards the cap holding chamber 54 by a distance equal to the diameter of the cap 140. Also, the cap next to the cap holding chamber 54 is pushed into the cap holding chamber 54. Then, the nail gun 20 is triggered to eject a nail through the opening 34 on the nose 32. The nail penetrates the cap in the cap holding chamber 54 and the tarpaper, and protrudes into the roof structure. The tarpaper is attached to the roof surface by the nail with a cap disposed between the tarpaper and the head of the nail. When the nail gun assembly 10 is lifted off the roof surface, the shuttle 80 moves back to the back position, and a cap is fed into the cap feeding chamber 52. Then, the nail gun assembly 10 is again ready for use.

What is claimed is:

1. A device for feeding staple or nail caps for use in conjunction with a hand-held automatic stapling or nailing gun, each cap having a diameter, the device comprising:

a base including a cap feeding chamber and a cap holding chamber connected by a channel extending into said cap feeding chamber and cap holding chamber and said channel extending between said cap feeding chamber and cap holding chamber a distance at least twice a diameter of each cap;

a cap holding container having a generally cylindrical interior configuration being axially disposed substantially perpendicular to the base, the container being operatively associated above the cap feeding chamber for feeding individual caps sequentially from the container into the cap feeding chamber, one cap at a time; and a shuttle sliding within the channel of the base, operable reciprocally from a position outside the cap feeding chamber toward the cap holding chamber to a position substantially filling the cap feeding chamber to move a single cap from the cap feeding chamber through the channel towards the cap holding chamber by a distance substantially equal to a diameter of the cap.

2. The device of claim 1 further including a cap holding mechanism.

3. The device of claim 2, wherein the cap holding mechanism includes a spring and a feeding pawl.

4. The device of claim 3 further including a ledge extending from a bottom of the channel into the cap holding chamber, wherein the spring of the cap holding mechanism presses the holding pawl against the ledge.

5. The device of claim 1 further including a piston-cylinder arrangement including a cylinder and a piston movably disposed in the cylinder, the piston being connected to the shuttle to move the shuttle in the channel of the base.

6. The device of claim 5 further including a two-position, four-way valve to control movement of the piston within the cylinder.

7. The device of claim 1, wherein the container contains a stack of coaxially arranged caps.

8. The device of claim 7, wherein the container includes a spring and a plunger disposed in the container, the spring biasing the plunger towards the cap feeding chamber of the base.

9. A staple or nail gun assembly comprising:

a staple or nail gun including, a head portion having an opening through which a staple or nail is expelled, and a handle portion having front and rear ends, the front end being attached to the head portion; and a device for feeding staple or nail caps, the device including, a base having a cap feeding chamber and a cap holding chamber connected by a channel extending into said cap feeding chamber and cap holding chamber, the cap feeding chamber being disposed near the rear end of the handle portion and the cap holding chamber being disposed adjacent the opening of the head portion, a container for storing staple or nail caps, the container having a generally tubular configuration and being disposed substantially perpendicular to the base, the container being operatively associated above the cap feeding chamber to sequentially feed individual caps stored in the container into the cap feeding chamber, one cap at a time, and a shuttle sliding reciprocally within the channel of the base from a position outside the cap feeding chamber toward the cap holding chamber to a position substantially filling the cap feeding chamber to move a single cap in the feeding chamber towards the cap holding chamber through the channel by a distance substantially equal to the diameter of the cap, whereby a staple or nail discharged through the opening of the head portion passes through the cap into the cap holding chamber.

10. The staple or nail gun assembly of claim 9, wherein the cap feeding device further includes a cap holding mechanism.

11. The staple or nail gun assembly of claim 10, wherein the cap holding mechanism includes a spring and a feeding pawl.

12. The staple or nail gun assembly of claim 11, where in the cap feeding device further includes a ledge extending from a bottom of the channel into the cap holding chamber, wherein the spring of the cap holding mechanism presses the holding pawl against the ledge.

13. The staple or nail gun assembly of claim 9 further including a piston-cylinder arrangement including a cylinder and a piston movably disposed in the cylinder, the piston being connected to the shuttle to move the shuttle in the channel of the base.

14. The staple or nail gun assembly of claim 13 further including a two-piston, four-way valve to control movement of the piston within the cylinder.

15. The staple or nail gun assembly of claim 9, wherein the cylindrical container contains a stack of co-axially arranged caps.

16. The staple of nail gun assembly of claim 15, wherein the container includes a spring and a plunger disposed in the container, the spring biasing the plunger towards the cap feeding chamber of the base.

17. The staple or nail gun assembly of claim 9, wherein the staple or nail gun assembly and the cap feeding device are pivotably connected to each other, the staple or nail gun assembly and the cap feeding device being movable relative to each other between an open position and a closed position.

18. The staple or nail gun assembly of claim 17 further including a spring disposed between the staple or nail gun assembly and the cap feeding device, wherein the spring of the assembly biases the staple or nail gun assembly and the cap feeding device in the open position.

19. A device for feeding staple or nail caps for use in conjunction with a hand-held automatic stapling or nailing gun, each cap having a diameter, the device comprising:

a base including a cap feeding chamber and a cap holding chamber connected by a channel having a bottom having a width substantially equal the diameter of the cap, and parallel lands forming substantially vertical sides to said channel, said channel extending into said cap feeding chamber and cap holding chamber and said channel extending between said cap feeding chamber and cap holding chamber a distance at least twice a diameter of each cap and terminating in a ledge extending into said cap holding chamber; and a cap holding container having a generally cylindrical configuration substantially perpendicular to the base, the container being operatively associated with the cap feeding chamber for feeding caps sequentially from the container into the cap feeding chamber, one cap at a time; and a shuttle sliding within the channel of the base, to move a cap from the cap feeding chamber through the channel towards the cap holding chamber by a distance substantially equal to a diameter of the cap; and a bracket affixed to said base, adjacent said cap holding chamber, having a spring-loaded cap holding pawl pivotally disposed on said bracket above the channel ledge, the pawl being resiliently biased against said ledge whereby, a cap advanced into said cap holding chamber intervenes between said ledge and pawl and is retained by the spring loaded pawl.

20. The device of claim 19 further additionally comprising a staple or nail gun including a head portion having an opening through which a staple or nail is expelled; and a handle portion having front and rear ends, the front end being attached to the head portion, a shuttle sliding reciprocally within the channel of the base from a position outside the cap feeding chamber toward the cap holding chamber to a position substantially filling the cap feeding chamber to move a single cap in the feeding chamber towards the cap holding chamber through the channel by a distance substantially equal to the diameter of the cap, whereby a staple or nail discharged through the opening of the head portion passes through the cap into the cap holding chamber.

* * * * *